US012710185B2

(12) United States Patent
Rogers

(10) Patent No.: US 12,710,185 B2
(45) Date of Patent: Aug. 18, 2026

(54) HVAC AIRFLOW MEASUREMENT WITH IN-SITU CALIBRATION

(71) Applicant: The Energy Conservatory, Inc., Minneapolis, MN (US)

(72) Inventor: Steven B. Rogers, Minneapolis, MN (US)

(73) Assignee: The Energy Conservatory, Inc., Minneapolis, MN (US)

( * ) Notice: Subject to any disclaimer, the term of this patent is extended or adjusted under 35 U.S.C. 154(b) by 672 days.

(21) Appl. No.: 18/168,063

(22) Filed: Feb. 13, 2023

(65) Prior Publication Data

US 2023/0266028 A1 Aug. 24, 2023

Related U.S. Application Data

(60) Provisional application No. 63/312,581, filed on Feb. 22, 2022.

(51) Int. Cl.

| | |
|---|---|
| ***F24F 11/38*** | (2018.01) |
| ***F24F 13/08*** | (2006.01) |
| *F24F 110/30* | (2018.01) |

(52) U.S. Cl.
CPC ..... *F24F 11/38* (2018.01); *F24F 13/085* (2013.01); *F24F 2110/30* (2018.01)

(58) Field of Classification Search
CPC ..... F24F 11/38
See application file for complete search history.

(56) References Cited

U.S. PATENT DOCUMENTS

| | | | | |
|---|---|---|---|---|
| 6,134,948 | A * | 10/2000 | Fuchigami | G01G 17/02 73/38 |
| 6,439,061 | B1 | 8/2002 | Nelson et al. | |
| 11,604,085 | B1 | 3/2023 | Koenig et al. | |
| 2016/0131381 | A1* | 5/2016 | Schmidlin | F24F 11/80 700/277 |
| 2017/0016642 | A1* | 1/2017 | Spalink | F24F 11/46 |
| 2021/0199330 | A1* | 7/2021 | Noboa | F24F 11/30 |
| 2022/0010996 | A1* | 1/2022 | Carrieri | F24F 8/108 |

* cited by examiner

*Primary Examiner* — Nathan L Laughlin
(74) *Attorney, Agent, or Firm* — HSML P.C.

(57) ABSTRACT

In-situ calibration of a flow measurement device in a forced air HVAC system. A flow measurement that is obtained by a flow measurement device that is temporarily installed in the HVAC system is used to calibrate a flow measurement device that is permanently installed in the HVAC system. The calibration described herein can be aided by a technician installing or servicing the HVAC system.

21 Claims, 4 Drawing Sheets

HVAC AIRFLOW MEASUREMENT WITH IN-SITU CALIBRATION

FIELD

Figure 1:
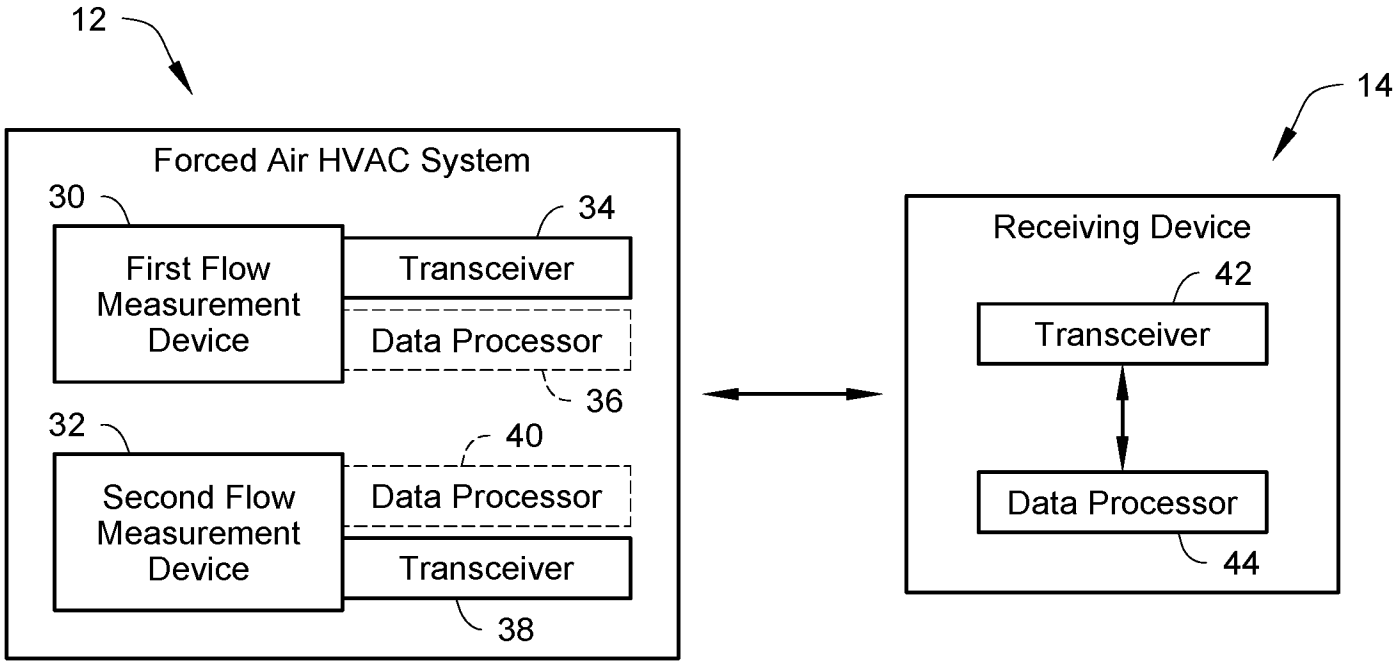

This technical disclosure relates to calibrating a flow measurement device installed in a forced air HVAC (heating, ventilation and air conditioning) system.

BACKGROUND

It is important for forced air HVAC systems to have proper airflow to ensure efficient operation of the systems. For particular HVAC systems, the airflow or air volume rates are required to be within specified airflow ranges. The flow of air is typically measured to ensure that the system was properly designed and installed and is operating according to specifications. Determining an unusually low or high airflow may indicate that a leak in the system or insufficient ventilation exists. An example of a known airflow measurement device for measuring airflow is disclosed in U.S. Pat. No. 6,439,061, and the TrueFlow® flow meter available from The Energy Conservatory of Minneapolis, Minnesota.

SUMMARY

Systems and methods are described for in-situ calibration of a flow measurement device in a forced air HVAC system. A flow measurement that is obtained by a flow measurement device that is temporarily installed in the HVAC system is used to calibrate a flow measurement device that is permanently installed in the HVAC system. The calibration described herein can be aided by a technician installing or servicing the HVAC system. Many existing permanently installed flow measurement devices can measure air flow repeatably but with large errors (poor accuracy). This is because forced air duct systems have many branches and short distances between bends and other fittings, and the air flow is very seldom fully developed or symmetrical. This problem is solved by using in-situ calibration with the temporarily installed flow measurement device as described herein to correct a repeatable but inaccurate measurement of the permanently installed flow measurement device so that the measurements thereof can be both accurate and repeatable.

The temporary installation of a flow measurement device refers to a flow measurement device that is configured and intended to be temporarily installed in the HVAC system for purposes of the calibration described herein at a suitable location for obtaining the flow measurement(s). Once calibration is completed, the temporarily installed flow measurement device is removed. The temporarily installed flow measurement device can be installed at any location in the HVAC system that is suitable to obtain its flow measurement (s) and that does not interfere with the flow measurement(s) of the permanently installed flow measurement device.

The permanently installed flow measurement device refers to a flow measurement device that is configured and intended to remain in the HVAC system for extended periods of time, including during typical or standard operation of the HVAC system. The permanently installed flow measurement device may be removable, for example during replacement or refurbishment thereof, but is otherwise intended to remain in position for extended periods of time to obtain flow measurements during typical/operation of the HVAC system.

In one embodiment, a method described herein can include using a first flow measurement that is obtained by a first flow measurement device of a forced air HVAC system to calibrate a second flow measurement device of the forced air HVAC system, wherein the first flow measurement is obtained while the first flow measurement device and the second flow measurement device are installed in the forced air HVAC system and the forced air HVAC system is operating. At the completion of calibration, the first flow measurement device is removed from the HVAC system.

In another embodiment, a system described herein can include a forced air HVAC system with a blower, a supply duct in fluid communication with the blower and receiving air therefrom, and a return duct in fluid communication with the blower and returning air thereto. A first flow measurement device is temporarily installable in the return duct at a first location, where the first flow measurement device includes a first wireless data transmitter. In addition, a second flow measurement device is permanently installed in the supply duct at a second location, where the second flow measurement device includes a second wireless data transmitter. A receiving device is in wireless communication with the first wireless data transmitter and with the second wireless data transmitter. The receiving device includes a data processor that is in communication with a storage device that includes instructions which, when executed by the data processor, configure the data processor to calibrate the second flow measurement device using one or more flow measurements obtained by the first flow measurement device.

DRAWINGS

FIG. 1 schematically depicts a system including a forced air HVAC system with in-situ calibration of a permanently installed flow measurement device.

Figure 2A:
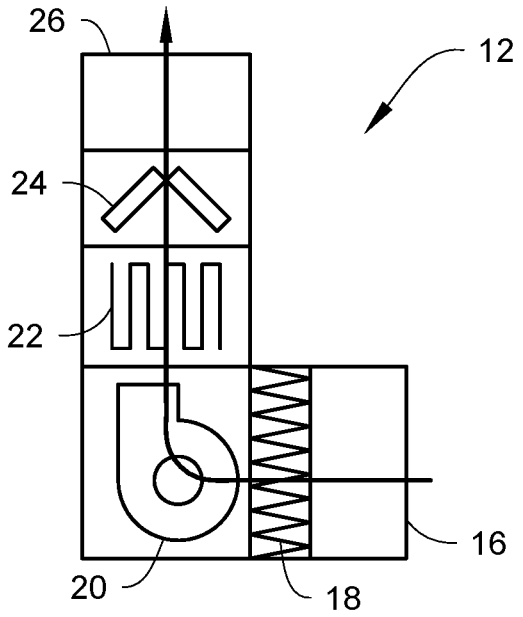
Figure 2B:
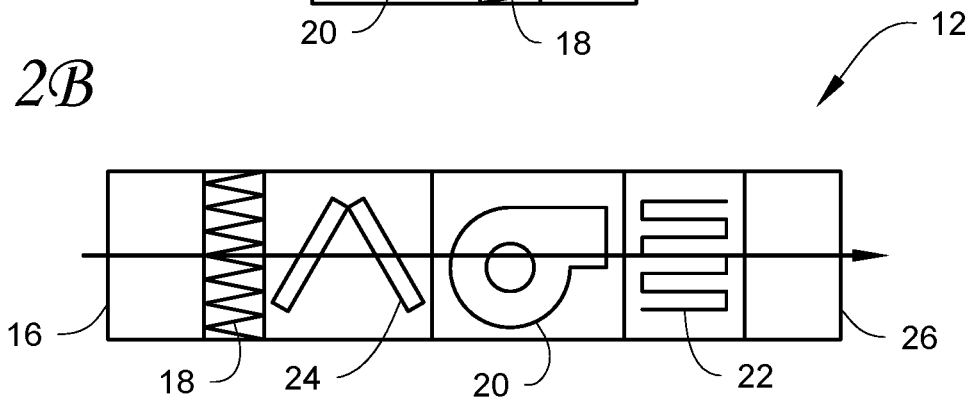
Figure 2C:
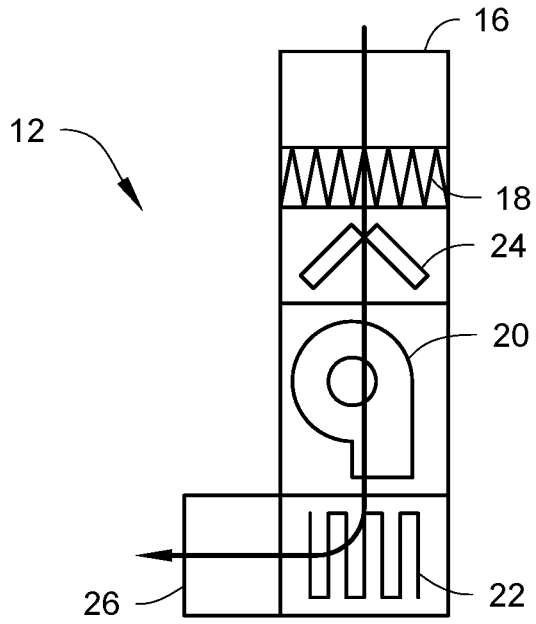

FIGS. 2A-C depict examples of forced air HVAC systems in which the in-situ calibration techniques described herein can be applied.

Figure 3A:
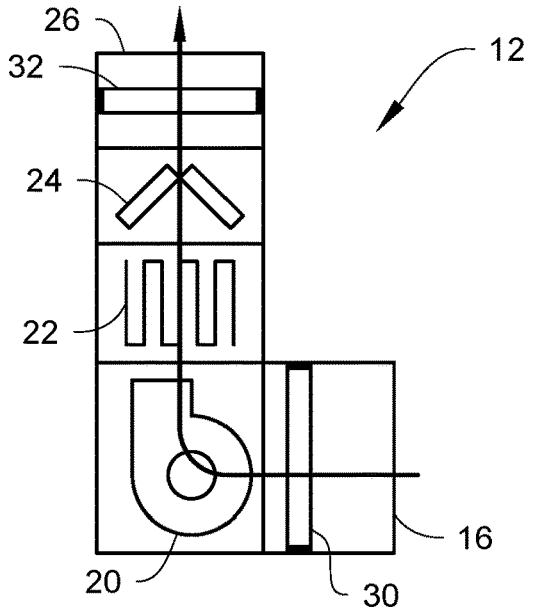
Figure 3B:
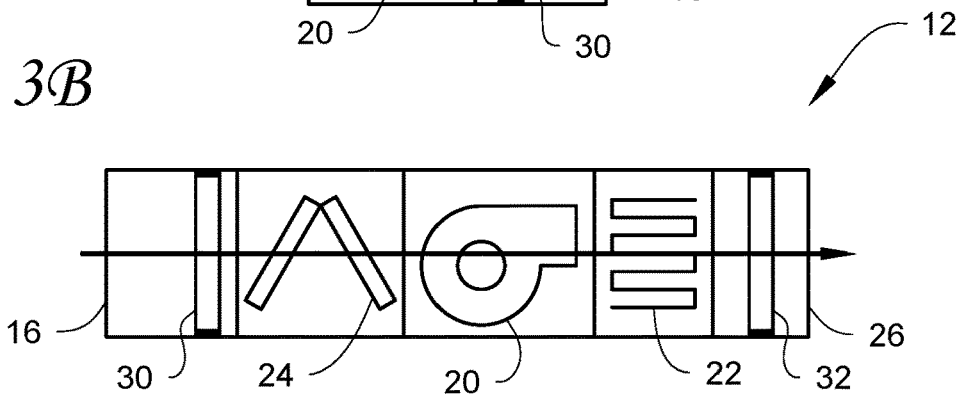
Figure 3C:
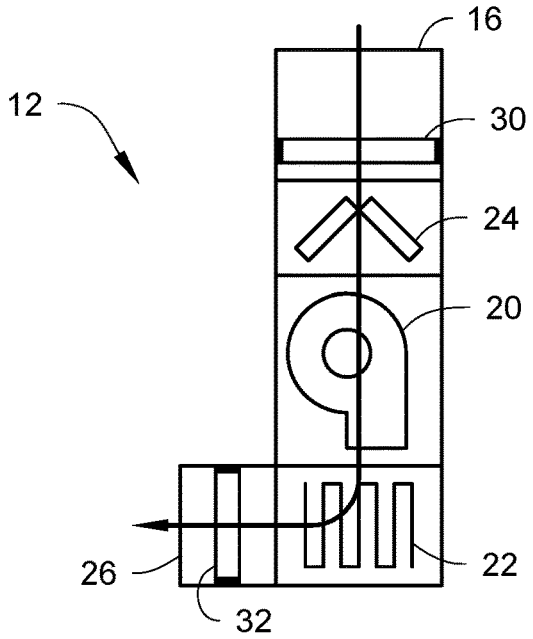

FIGS. 3A-C are similar to FIGS. 2A-C but with the flow measurement devices described herein installed.

Figure 4:
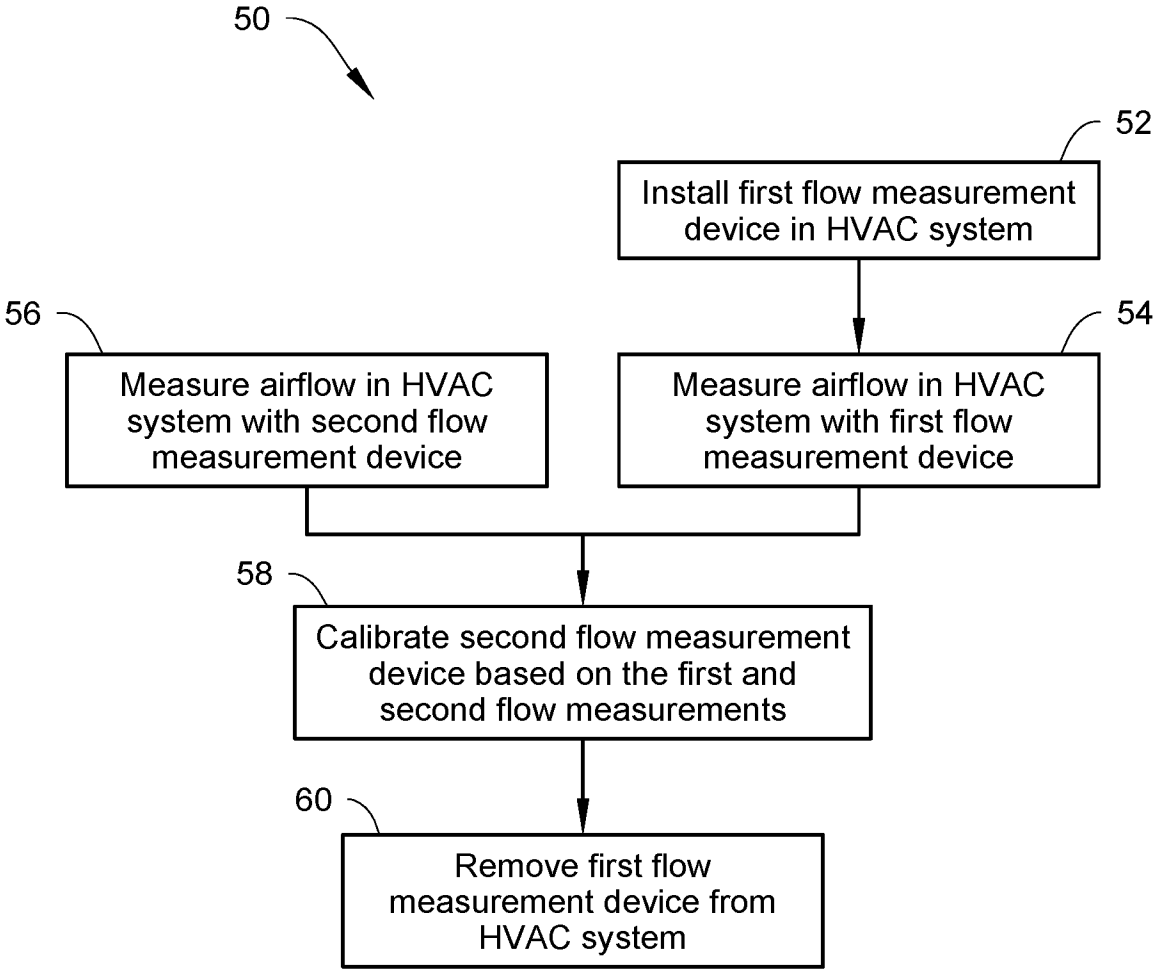

FIG. 4 depicts an example of an in-situ calibration method described herein.

DETAILED DESCRIPTION

FIG. 1 schematically depicts a system 10 that includes a forced air HVAC system 12 and a receiving device 14 in wireless (or wired) two-way communication with the HVAC system 12. Although FIG. 1 depicts the HVAC system 12 and the receiving device 14 as being separate from one another, the receiving device 14 can be integrated into the HVAC system 12 so that the functions of the receiving device 14 described herein can be performed on or by the HVAC system 12.

FIGS. 2A-C illustrate examples of forced air HVAC systems 12 that can be used. For example, FIG. 2A illustrates an upflow HVAC system 12 with a return duct 16, an air filter 18, a blower or fan 20, a heating coil 22, a cooling coil 24, and a supply duct 26. Air flow through the system in FIG. 2A is indicated by the arrow. FIG. 2B illustrates a horizontal HVAC system 12 with the return duct 16, the air filter 18, the blower or fan 20, the heating coil 22, the cooling coil 24, and the supply duct 26. Air flow through the system in FIG. 2B is indicated by the arrow. FIG. 2C illustrates a downflow HVAC system 12 with the return duct 16, the air filter 18, the blower or fan 20, the heating coil 22, the cooling coil 24, and the supply duct 26. Air flow through the system in FIG. 2C is indicated by the arrow. Other HVAC system configurations can be used as well. The HVAC system 12 may be a residential HVAC system or a commercial HVAC system. The construction and operation of forced air HVAC systems is well known to those of ordinary skill in the art.

Returning to FIG. 1, the system 10 also includes a first flow measurement device 30 and a second flow measurement device 32. The flow measurement devices 30, 32 are configured to directly or indirectly obtain air flow readings at different locations in the HVAC system 12. For example, the air flow readings can be the volumetric flow, for example measured in cubic feet per minute (CFM), or mass flow. In other embodiments, the air flow readings can be the air velocity, for example measured in feet per minute (FPM) which can then be multiplied by the cross-sectional area of the ducts the devices 30, 32 are located in to get volumetric flow. In still other embodiments, the devices 30, 32 can measure various pressure parameters which can then be converted into the air flow readings. So the term "air flow reading" or similar as used herein and in the claims, unless indicated by Applicant otherwise, refers to volumetric flow, mass flow, or any other measurement indicative of air flow, whether obtained by the devices 30, 32 directly or indirectly (for example via a velocity measurement or via measured pressure parameters).

The flow measurement device 30 is temporarily installed in the HVAC system 12 at a location that does not interfere with the flow measurement(s) of the flow measurement device 32 which is permanently installed in the HVAC system 12. The flow measurements devices 30, 32 are installed at different locations in the system 12. For example, one of the flow measurement devices 30, 32 can be installed at a supply side of the system 12 while the other one of the flow measurement devices 30, 32 can be installed at a return or suction side of the system 12. In one embodiment, the flow measurement device 30 can be installed in the return/suction side of the system 12 while the flow measurement device 32 can be installed in the supply side. In another embodiment, the flow measurement device 32 can be installed in the return/suction side of the system 12 while the flow measurement device 30 can be installed in the supply side. In another embodiment, the flow measurement device 30 is temporarily installed in the system 12 while the flow measurement device 32 is permanently installed. In another embodiment, the flow measurement device 32 is temporarily installed in the system 12 while the flow measurement device 30 is permanently installed.

Referring to FIG. 1 together with FIGS. 3A-C, the first flow measurement device 30 will be described. The flow measurement device 30 will be described as being temporarily installed in the system 12 at the return/suction side of the system 12. For example, the flow measurement device 30 can be configured to be temporarily installed in the system 12 at the location of the filter 18 (see FIGS. 2A-C) by removing the filter 18 from the filter slot and installing the flow measurement device 30 in its place. In an embodiment, the flow measurement device 30 can comprise a flow grid having a pressure drop approximately equal to a pressure drop of a filter that is installable in the filter slot or a filter grille. The flow measurement device 30 is configured in any manner to be able to obtain one or more airflow readings once installed in the system 12 and the system 12 is operated. An example of a type of flow measurement device 30 that can be used is described in U.S. Pat. No. 6,439,061 and U.S. patent application Ser. No. 17/222,224 filed on Apr. 5, 2021 and titled Airflow Measurement Device For Airflow Measurement each of which is incorporated herein by reference in its entirety, and the TrueFlow® flow meter available from The Energy Conservatory of Minneapolis, Minnesota. In another embodiment, the flow measurement device 30 can be temporarily installed at other locations in the system 12, for example in place of a filter at a filter grille of the system 12.

Referring to FIG. 1, the flow measurement device 30 can include wireless (for example WiFi, Bluetooth, or the like) or wired communication capability. For example, the flow measurement device 30 can include a transceiver 34 that can at least transmit signals, such as flow measurement readings, externally of the flow measurement device 30. The transceiver 34 may also optionally receive signals. The flow measurement device 30 may also optionally include one or more data processors 36 (illustrated in broken lines) for processing data obtained by the flow measurement device 30 and/or to process data received by the transceiver 34. Power for powering operation of the flow measurement device 30 can be provided by one or more batteries mounted on the flow measurement device 30. Alternatively, the flow measurement device 30 can receive mains power via a power cable plugged into an electrical outlet.

Referring to FIG. 1 together with FIGS. 3A-C, the second flow measurement device 32 will be described as being permanently installed in the system 12 at the supply side of the system 12. For example, the flow measurement device 32 can be configured to be installed in the system 12 in the supply duct 26 downstream of the cooling coil 24 as depicted in FIGS. 3A-C. In an embodiment, the flow measurement device 32 can comprise an averaging pitot tube array with pressure sensor including, but not limited to, an auto-zeroing type of pressure sensor. An example of a suitable flow measurement device 32 that can be used is the Series FLST Duct Mounted Airflow Measurement Station available from Dwyer Instruments, LLC of Michigan City, Indiana. However, the flow measurement device 32 can be configured in any manner to be able to obtain one or more airflow readings once installed in the system 12 and the system 12 is operated.

With continued reference to FIG. 1, the flow measurement device 32 can include wireless (for example WiFi, Bluetooth, or the like) or wired communication capability. For example, the flow measurement device 30 can include a transceiver 38 that can at least transmit signals, such as flow measurement readings, externally of the flow measurement device 32. The transceiver 38 may also optionally receive signals. The flow measurement device 32 may also optionally include one or more data processors 40 (illustrated in broken lines) for processing data obtained by the flow measurement device 32 and/or to process data received by the transceiver 38. Power for powering operation of the flow measurement device 32 can be provided by one or more batteries mounted on the flow measurement device 32. Alternatively, the flow measurement device 32 can receive mains power via a power cable plugged into an electrical outlet or via hardwired power techniques.

With continued reference to FIG. 1, the receiving device 14 is separate from the system 12. The receiving device 14 is configured to receive data indicative of a flow measurement from one or both of the flow measurement devices 30, 32, preferably from both of the flow measurement devices 30, 32. The receiving device 14 processes the data to compare the flow measurements obtained by the flow measurements devices 30, 32 to one another. The results of this comparison is used to calibrate the second flow measurement device 32. For example, the first flow measurement device 30 is typically considered to provide highly accurate flow measurement readings and provides an accurate measurement of the airflow parameters through the system 12. Therefore, any difference in the flow measurement readings of the flow measurement device 30 and the flow measurement device 32 can indicate that the flow readings of the flow measurement device 32 are off and can be adjusted (i.e. calibrated) based on the determined difference from the flow measurement of the flow measurement device 30. In an embodiment, the calibration can be performed based on a single flow measurement from each of the flow measurement devices 30, 32. In another embodiment, multiple measurements can be obtained by each of the flow measurement devices 30, 32 to produce multiple calibration calculations, with an average of the calibration calculations being determined and used to calibrate the second flow measurement device 32.

The receiving device 14 can include wireless (for example WiFi, Bluetooth, or the like) or wired communication capability. For example, the receiving device 14 can include a transceiver 42 that can receive signals, such as flow measurement readings, from the flow measurement devices 30, 32. The transceiver 42 may also optionally transmit signals. The receiving device 14 also includes one or more data processors 44 for processing data received from the flow measurement devices 30, 32. Power for powering operation of the receiving device 14 can be provided by one or more batteries of the receiving device 14. Alternatively, the receiving device 14 can receive mains power via a power cable plugged into an electrical outlet. In an embodiment, the receiving device 14 can comprise a mobile phone, a tablet computer, a laptop computer, or a personal computer. A mobile app or other software application on the receiving device 14 can process the received data to determine the calibration of the second flow measurement device 32. In an embodiment, the functions of the receiving device 14 described herein can be incorporated into the flow measurement device 32 and/or the flow measurement device 30.

FIG. 4 illustrates an example of a method 50 of calibrating the second flow measurement device. At 52, the first flow measurement device is temporarily installed in the HVAC system, for example in the filter slot or the filter grille as described above. With the HVAC system operating, a flow measurement is then obtained at 54 using the first flow measurement device, and a flow measurement is obtained at 56 using the second flow measurement device. The flow measurements at 54, 56 can be obtained at generally the same time, or one can be obtained prior to the other. The flow measurements are then provided to the receiving device which then, at 58, calibrates the second flow measurement device based on the first and second flow measurements. Once calibration is complete, the first flow measurement device is removed from the HVAC system at 60 and the filter is reinstalled.

In an embodiment, if the difference between the readings of the first flow measurement device and the second flow measurement device is too great, for example a difference of greater than about 50% or greater than about 75%, an action other than calibration can take place. For example, the mobile app can issue a notice to the user to move the second flow measurement device to an alternate location in the system 12 since a large difference may indicate that the second flow measurement device is located in an eddy outside the main stream of air flow. Alternatively, the large difference could indicate a malfunction of the second flow measurement device and the mobile app can issue a notice to the user to replace or repair the second flow measurement device.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of calibrating a flow measurement device, the method comprising:

obtaining a first flow measurement by a first flow measurement device of a forced air HVAC system;

calibrating a second flow measurement device of the forced air HVAC system in-situ, wherein the first flow measurement is obtained while the first flow measurement device and the second flow measurement device are installed in series in the forced air HVAC system to measure a volumetric or mass of air flow through the HVAC system and the forced air HVAC system is operating, wherein the calibrating of the second flow measurement device is based on a difference in the first flow measurement and a second flow measurement by the second flow measurement device; and removing the first flow measurement device after calibrating the second flow measurement device.

2. The method of claim 1, wherein the first flow measurement device is temporarily installed at a first location of the forced air HVAC system, and the second flow measurement device is permanently installed at a second location of the forced air HVAC system.

3. The method of claim 2, wherein the first location is at a return side of the forced air HVAC system, and the second location is at a supply side of the forced air HVAC system.

4. The method of claim 2, where the first location is a filter slot of the forced air HVAC system or a filter grille of the forced air HVAC system.

5. The method of claim 2, where the second location is a supply duct of the forced air HVAC system.

6. The method of claim 2, where the second location is a return duct of the forced air HVAC system upstream of the first location such that the second flow measurement device creates negligible interference with the first flow measurement device.

7. The method of claim 1, wherein the first flow measurement device transmits the first flow measurement to a receiving device separate from the first flow measurement device; and wherein the second flow measurement device obtains a second flow measurement and transmits the second flow measurement to the receiving device.

8. The method of claim 7, comprising using the receiving device to calibrate the second flow measurement device.

9. The method of claim 7, wherein the receiving device comprises a mobile phone, a tablet computer, a laptop computer, or a personal computer.

10. The method of claim 4, wherein the first flow measurement device comprises a flow grid having a pressure drop approximately equal to a pressure drop of a filter that is installable in the filter slot or the filter grille.

11. The method of claim 1, wherein the second flow measurement device comprises an averaging pitot tube array.

12. The method of claim 1, wherein when the difference in the first flow measurement and the second flow measurement is greater than at least 75%, the second flow measurement device is replaced.

13. The method of claim 1, wherein the forced air HVAC system comprises a residential forced air HVAC system.

14. A method comprising:

in a forced air HVAC system in which a first flow measurement device is installed at a first location and a second flow measurement device is installed at a second location in series with the first flow measurement device to measure a volumetric or mass of air flow through the HVAC system, obtaining a first flow measurement using the first flow measurement device and obtaining a second flow measurement using the second flow measurement device;

comparing the first flow measurement and the second flow measurement;

calibrating the second flow measurement device in-situ or replacing the second flow measurement device based on a determined difference between the first flow measurement and the second flow measurement; and removing the first flow measurement device after calibrating the second flow measurement device.

15. A system comprising:

a forced air HVAC system with a blower, a supply duct in fluid communication with the blower and receiving air therefrom, and a return duct in fluid communication with the blower and returning air thereto;

a first flow measurement device that is temporarily installable in the return duct at a first location, the first flow measurement device includes a first wireless data transmitter;

a second flow measurement device that is permanently installed in the supply duct at a second location, the second flow measurement device includes a second wireless data transmitter; and a receiving device in wireless communication with the first wireless data transmitter and with the second wireless data transmitter, the receiving device includes a data processor that is in communication with a storage device that includes instructions which, when executed by the data processor, configure the data processor to calibrate the second flow measurement device in-situ using one or more flow measurements obtained by the first flow measurement device, wherein the first flow measurement device and the second flow measurement device are installed in series in the forced air HVAC system to measure a volumetric or mass of air flow through the HVAC system, wherein calibrating the second flow measurement device in-situ is based on a difference in the one or more flow measurements by the first flow measurement device and a flow measurement by the second flow measurement device.

16. The system of claim 15, where the first location is a filter slot or a filter grille.

17. The system of claim 15, wherein the receiving device comprises a mobile phone, a tablet computer, a laptop computer, or a personal computer.

18. The system of claim 16, wherein the first flow measurement device comprises a flow grid having a pressure drop approximately equal to a pressure drop of a filter that is installable in the filter slot or the filter grille.

19. The system of claim 15, wherein the second flow measurement device comprises an averaging pitot tube array.

20. The system of claim 15, wherein the forced air HVAC system comprises a residential forced air HVAC system.

21. The system of claim 15, wherein the forced air HVAC system further comprises a heating coil and a cooling coil; and the blower, the heating coil and the cooling coil are located in a flow path between the first flow measurement device and the second flow measurement device.

* * * * *